United States Patent [19]

Heller

[11] Patent Number: 4,885,806

[45] Date of Patent: Dec. 12, 1989

[54] FACE PROTECTIVE MEMBER FOR BATTER'S HELMETS

[76] Inventor: Denis W. Heller, P.O. Box 1011, Tualatin, Oreg. 97062

[21] Appl. No.: 309,997

[22] Filed: Feb. 10, 1989

Related U.S. Application Data

[63] Continuation of Ser. No. 126,232, Nov. 27, 1987, abandoned.

[51] Int. Cl.[4] ..... A63G 71/10

[52] U.S. Cl. ..... 2/423; 2/424; 2/425

[58] Field of Search ..... 2/411, 9, 422, 423, 2/424, 425

[56] References Cited

U.S. PATENT DOCUMENTS

| | | | |
|---|---|---|---|
| 1,868,926 | 7/1932 | Tatore et al. | 2/425 X |
| 2,214,748 | 9/1940 | Mauro | 2/423 |
| 2,944,263 | 7/1960 | Rayburn et al. | 2/9 |
| 3,290,693 | 12/1966 | Wolfe | 2/423 |
| 3,491,372 | 1/1970 | Aileo | 2/9 |
| 3,886,596 | 6/1975 | Franklin et al. | 2/9 |
| 4,660,230 | 4/1987 | Mayling | 2/413 |
| 4,677,694 | 7/1987 | Crow | 2/9 |
| 4,718,127 | 1/1988 | Rittmann et al. | 2/424 |

FOREIGN PATENT DOCUMENTS

| | | | |
|---|---|---|---|
| 2532528 | 3/1984 | France | 2/424 |

*Primary Examiner*—Wm. Carter Reynolds
*Attorney, Agent, or Firm*—Eugene M. Eckelman

[57] ABSTRACT

A shield plate has supporting structure at one of its ends for securement to the ear flap of a batting helmet. Such support structure holds the shield plate in one of two positions, one such position being a forwardly extending down position protecting the face but spaced sufficiently low to allow side vision for the batter, the other position being an up or out of the way position overlying an upper portion of the helmet. The shield plate is adjustable to selectively position it at different angles relative to the ear flap in its down position. The shield plate may be fitted on original manufactured helmets or on existing helmets.

3 Claims, 1 Drawing Sheet

FIG. 4
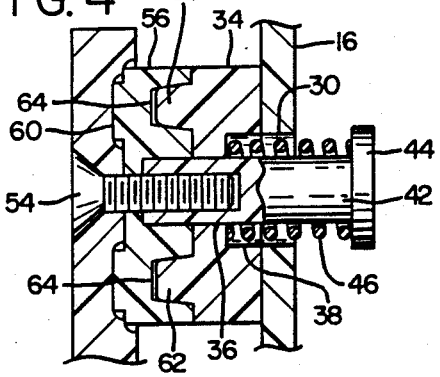
FIG. 1
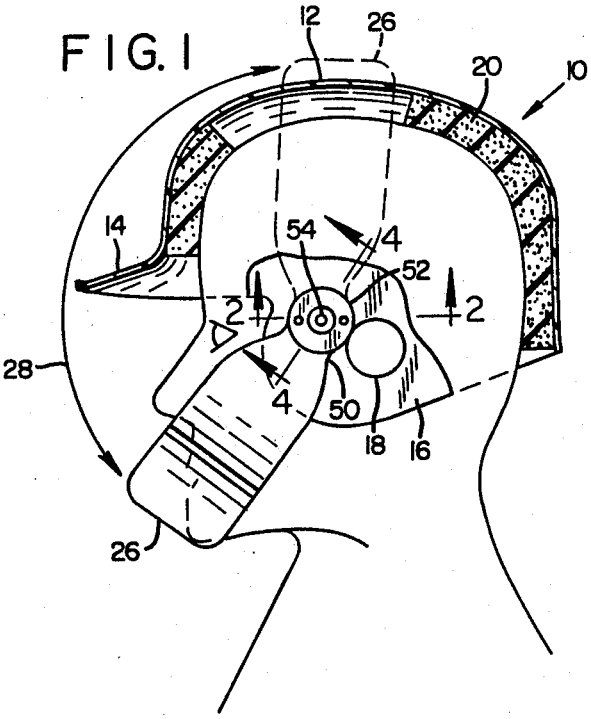
FIG. 3
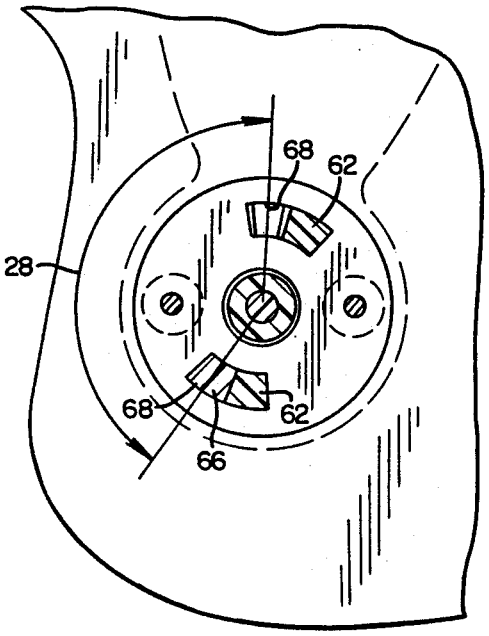
FIG. 2
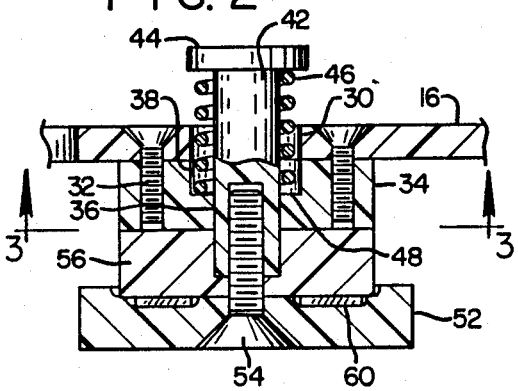
FIG. 5
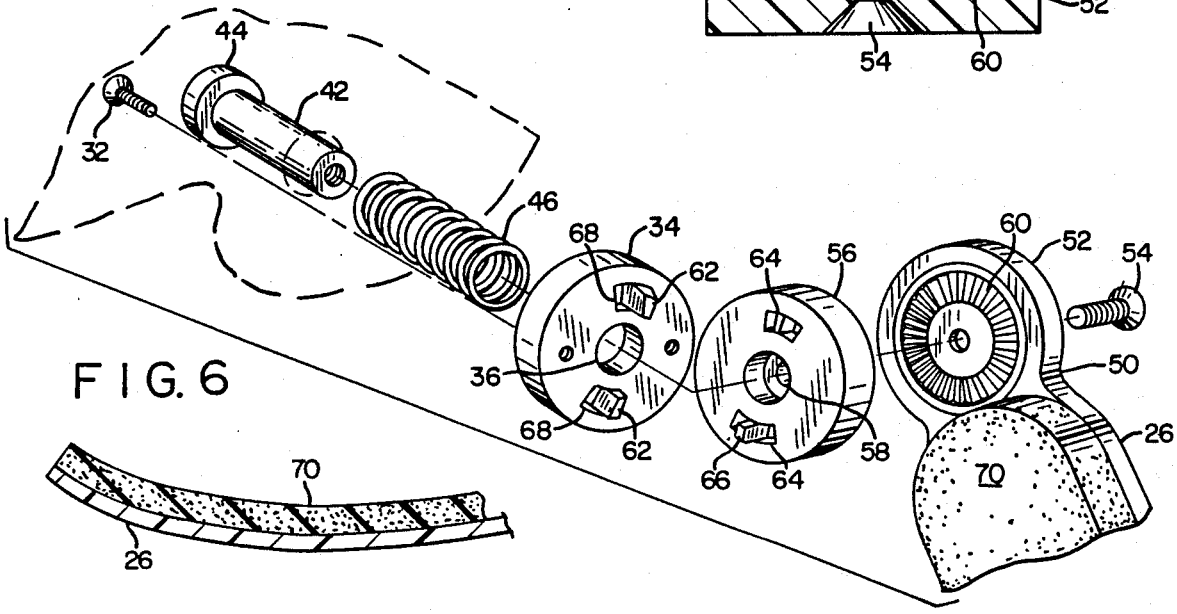
FIG. 6

FACE PROTECTIVE MEMBER FOR BATTER'S HELMETS

This application is a continuation of application Ser. No. 07/126,232, filed Nov. 27, 1987, now abandoned.

BACKGROUND OF THE INVENTION

This invention relates to new and useful improvements in batter's helmets and is particularly concerned with a batter's helmet of the type having a face protective member associated therewith.

Various types of protective head gear have been provided in the form of helmets or the like which are intended to prevent injuries to the head from baseballs or softballs. Most helmets now in use employ ear flaps designed to protect the ear and at least one side of the face. Such structures are illustrated in U.S. Pat. Nos. 2,214,748, 3,886,596 4,660,230 and 4,677,694. As seen in some of these patents, developments have gone further for protecting portions of the face. Although these latter protective additions serve effectively to protect the face, they have the disadvantage that they add weight to the helmet and further cause some obstruction of the batter's sight. Although these drawbacks must be acceptable at the time the person is batting, they are objectionable after the person reaches base. Such helmets are designed primarily for the younger players and regulations usually require that the helmet stay in place while batting and also while on base. When the runner is on base however, protection is not necessary for the side of the face.

SUMMARY OF THE INVENTION

According to the present invention and forming a primary objective thereof, a face protective member is provided for batter's helmets which has minimum weight and which can be swung out of the way after the batter has reached base.

Another object is to provide a face protective member for batter's helmets of the type described which is pivotally attached to the ear flap of the helmet and which is readily movable by the batter between a down position which guards the face and an upper out-of-the-way position lying along a top portion of the helmet.

In carrying out the objectives of the invention, a shield plate having dimensions arranged to protect the batter's face is supported at one of its ends on an ear flap of the helmet. The support of the shield plate on the ear flap provides at least two pivot positions, one such position comprising a forwardly extending down position protecting the face but spaced sufficiently low to allow side vision for the batter and the other position comprising an up position disposed in spaced relation from the face and overlying an upper portion of the helmet. Latch means are provided at the two positions of the shield plate, and resilient means operate on these latch members to hold them securely in the two positions but to allow manual forced separation of the members for rotating shield plate from one position to the other. A finger grip portion is provided on the shield plate for manually gripping the latter and moving it between the two positions.

The invention will be better understood and additional objects and advantages will become apparent from the following description taken in connection with the accompanying drawings.

BRIEF DESCRIPTION OF THE DRAWINGS

FIG. 1 is a side elevational view, partly broken away, of a person wearing a batter's helmet of the type employing the face protective member of the instant invention.

FIG. 2 is an enlarged fragmentary sectional view taken on the line 2—2 of FIG. 1.

FIG. 3 is a sectional view taken on the line 3—3 of FIG. 2.

FIG. 4 is an enlarged fragmentary sectional view taken on the line 4—4 of FIG. 1.

FIG. 5 is a perspective exploded view of latching and support parts of the invention; and FIG. 6 is an enlarged fragmentary plan or edge view of the protective member.

DETAILED DESCRIPTION OF A PREFERRED EMBODIMENT

With reference first to FIG. 1, the numeral 10 designates a batter's helmet of conventional type, having an upper domed portion 12 which fits over and protects a major portion of the head, a front visor portion 14 and side ear flaps 16. Ear flaps 16 are provided with openings 18 for transmission of sound. The helmet is provided with suitable interior padding 20.

The invention comprises in general a shield plate 26 arranged to protect one side only of a batter's face. It is pivotally attached to the ear flap 16 of the helmet and movable between two latched positions, namely, a down position as shown in full lines in FIG. 1 and an up position as shown in broken lines. Arrow 28 illustrates the pivotal movement between between these positions. In the down position, the shield plate guards the side of the face and has selected spacing from the visor portion 14 to protect the eye but at the same time to allow side vision. In the up position, the shield plate lies along the upper domed portion of the helmet, preferably in substantially a vertical position, and is out of the way.

The present protective member may be attached to a helmet during manufacture or its design allows it to be attached to existing helmets. In its structure, the helmet is provided with an aperture 30 in the ear flap 16, FIGS. 2 and 4, preferably forward of the ear opening 18. Secured to the outer surface of the ear flap 16 over the aperture 30, as by means of screws 32, is a mounting or base block 34. This mounting block has a central bore 36 and counterbore 38 aligned with the helmet aperture 30.

A shaft 42 is mounted in the aperture 30 and bore 36 and has a head 44 for confining a compression spring 46 between it and a shoulder 48 between the bore 36 and counterbore 38.

The inner end of the shield plate 26 has a narrowed portion 50 which leads into a rounded finger grip end 52 to which is connected, by means of a central screw 54, a round turning block or disc member 56 of approximately the same diameter as mounting block 34 but smaller than the rounded end 52 of the shield plate 26. Screw 54 passes freely through the turning block 56 and has threaded connection in the shaft 42 for secured clamping engagement of these three elements, the shaft 42 having fitted engagement in a counterbore 58 in the block 56. The engaging or mating surfaces 60 of the members 52 and 56 are toothed whereby relative fixed rotative adjustment can be provided between the shield plate 26 and the turning block 56 to adjust to different positions when down. This adjustment is done by first loosening the crew 54, then making the rotative adjustment, and then tightening the screw.

The engaging or facing surfaces of mounting block 34 and turning block 56 include latching means for positively holding the shield plate 26 in either its down or up position and for conveniently turning such plate between the two positions. Such latch means comprises a pair of detents 62, FIGS. 3, 4 and 5, projecting from the face of the mounting block 34 and arranged to ride against the face of the turning block 56 when the shield plate is being turned from one position to the other and arranged to engage recesses 64 in the face of the turning block 56 when in the two positions of the shield plate. Turning block 56 has a stabilizing projection 66 arranged to ride on the face of the mounting block 34 when the shield plate is being turned from one position to the other and for engaging one or other of recesses 68 adjacent each of the detents 62.

The latching means are dimensioned and arranged such that in the down or operative position of the shield plate 26, the stabilizing projection 66 will engage one of the recesses 68 and both the detents 62 will be engaged in respective recesses 64. Such position is shown in FIG. 3. When it is desired to move the shield plate to its up or inoperative position, the batter grasps the rounded end 52 and pulls outwardly to disengage stabilizing projection 66 from the on recess 68 and detents 62 from the recesses 64 that they engage. By slightly turning the shield plate toward its up position, the spacing projecting 66 and the detents 62 will be disengaged from their respective recesses and the ends of the spacing projection 66 and detents 62 will ride on the opposite faces and allow easy turning to the up position. When the shield plate reaches its up position, the spacing projection 66 will snap into the other recess and detents 62 will snap into the other recesses 64, thus allowing the turning block 56 to lie in face engagement with the mounting block 34. The latching means thus holds the shield plate positively in place. The shield plate is moved down to its operative position by pulling it outwardly and rotating it down until the latch means snap into place.

According to the present invention, a face protective shield is provided that has minimal weight and after the batter has reached base it can be turned upwardly to be completely out of the way. With reference to FIG. 6, the shield plate 26 is curved to fit substantially the contour of the batter's face and also such contour allows it to fit closely to the domed portion of the helmet in its up position. Shield plate 26 includes suitable padding 70 similar to the interior of the helmet. Such shield plate is of a width to adequately cover the lower portion of the face and in combination with the visor 14 of the helmet also protects the upper portion of the face. Suitable adjustment to suit various batters can be made by adjustment of the base plate 26 relative to its turning block 56 by means of mating teeth 60.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A batter's helmet comprising:

a domed shell shaped to fit the head of a batter and arranged to protect the upper portion of the head, a downwardly extending ear flap on at least one side of said domed shell arranged to protect the ear and a portion of the neck, a face protective member comprising a shield plate having opposite ends and being arranged to protect one side only of a batter's face, and support means supporting said shield plate at one of its ends on said ear flap, said support means comprising a base member secured to the ear flap of said helmet, latch means on said base member directed outwardly from said helmet, a disc member, means securing said disc member to said shield plate for rotation therewith between two positions of said shield plate comprising a forwardly extending down position which protects the side of the batter's face and an up position overlying an upper portion of said helmet, said shield plate being dimensioned in width such that in its down forwardly extending position it protects the face but is spaced sufficiently low from the batter's eyes to allow side vision, latch means on said disc member directed inwardly toward said helmet and having cooperative engagement with the latch means on said base member, spring means normally urging said base member and disc member together and providing a positive, non-rotative locked engagement of the latch means on said disc member with the latch means on said base member in each of the two positions of said shield plate, and a finger grip end on said shield plate at said disc member arranged to be grasped by the batter and pulled outwardly against the force of said spring means to disengage the latch means on said disc member from the latch means on said base member to allow said shield plate to be rotated from one locked position to the other.

2. The face protective member of claim 1 wherein said shield plate is concaved to conform generally to the shape of a person's face when said plate is in its down position and to lie close to the domed shell of a helmet when in its up position.

3. The face protective member of claim 1 including adjustment means in said means that secure said disc member to said shield plate to selectively position said shield plate at different angles relative to said ear flap in said down position.

* * * * *